United States Patent [19]

Alper

[11] 4,451,027

[45] May 29, 1984

[54] CONSTANT SPACING DOCUMENT FEEDER

[75] Inventor: Daniel D. Alper, Ypsilanti, Mich.

[73] Assignee: Burroughs Corp., Detroit, Mich.

[21] Appl. No.: 358,156

[22] Filed: Mar. 15, 1982

Related U.S. Application Data

[63] Continuation of Ser. No. 110,593, Jan. 9, 1980, abandoned.

[51] Int. Cl.[3] ..... B65H 3/52; B65H 5/34

[52] U.S. Cl. ..... 271/10; 271/122; 271/259; 271/270; 271/274; 198/461; 198/575; 198/577

[58] Field of Search ..... 271/10, 270, 272, 273, 271/274, 122, 114, 35, 202, 203, 314, 110, 111, 265, 258, 259; 198/460, 461, 575, 577, 579, 572

[56] References Cited

U.S. PATENT DOCUMENTS

| | | | |
|---|---|---|---|
| 3,771,783 | 11/1973 | McInerny | 271/122 X |
| 3,827,545 | 8/1974 | Buhayar | 271/203 X |
| 4,077,620 | 3/1978 | Frank et al. | 271/10 |
| 4,113,244 | 9/1978 | Ruenzi | 271/270 X |
| 4,140,310 | 2/1979 | Schroter | 271/270 X |
| 4,158,456 | 6/1979 | Holland-Letz | 271/125 X |
| 4,318,540 | 3/1982 | Paananen et al. | 271/270 X |
| 4,331,328 | 5/1982 | Fasig | 271/270 |

*Primary Examiner*—Bruce H. Stoner, Jr.

*Attorney, Agent, or Firm*—Edmund M. Chung; Kevin R. Peterson; Delbert P. Warner

[57] ABSTRACT

An improved document feeder employs sets of rollers between which it feeds documents of different lengths to generate and maintain gaps of equal length between the documents while transporting them at a constant speed. A first group of rollers separate stacked documents and start the documents moving at a low speed along the track. A second group of rollers, operated at a higher speed, receive documents from the first group of rollers and increase the speed of the first document relative to a second document, still in contact with the first group of rollers, thereby providing an initial gap which continues to lengthen until the second document reaches the second group of rollers. A third group of rollers receives the documents after they leave the second group, imparting a constant system transport speed to them. The first and second groups of rollers are then able to further adjust the gap by changing the speed of a second document, and after the desired gap has been established, reverting to transport speed before transferring the second document to the third group of rollers.

7 Claims, 5 Drawing Figures

CONSTANT SPACING DOCUMENT FEEDER

This is a continuation of application Ser. No. 110,593, filed Jan. 9, 1980, now abandoned.

BACKGROUND OF THE INVENTION

1. Field of the Invention

The invention relates to document feeding devices and more particularly to means for providing gaps of equal length between documents of uneven lengths and for transmitting those documents at a constant speed. It relates further to improved means for separating documents into a single column of documents separated by gaps after the documents have been received in overlapping stacks.

2. Description of the Prior Art

Prior art constant-spacing document feeders have depended on stopping and starting to provide spaces between documents. That procedure has been hard on the documents and has tended to wear the mechanism of the feeder excessively as well as to consume a great deal of energy. For high-speed, short-gap feeding systems, the large accelerating forces required to speed up or slow down such an intermittently driven system are unrealistically high.

Among the known prior art devices is a "Constant Spacing Document Feeder" disclosed in U.S. Pat. No. 4,318,540 which uses an approximation method based on document length for gap control in which the feeding element operates between two substantially different speeds. While that system serves to eliminate the need to bring the feeding element to a complete stop, it typically requires changes in speed twice for every document, resulting in high stresses and high energy consumption. It will be noted also that while that method does have the effect of substantially cutting down on gap variation, it is inherently inexact and does not yield the full benefits of a constant spacing feeder. Furthermore, documents processed by that prior art apparatus are often released at speeds other than the transport speeds so a secondary uncontrolled acceleration occurs after there has been a gap adjustment. This adds further to the system inaccuracy.

The prior art friction feeders for use in initially separating documents which are received as stacks of paper or cards into a stream of documents separated by gaps have used two methods to control the normal force applied as documents were separated into an end-to-end flow of documents. The first method was to augment the relatively constant normal force between the feeder and the scrubber with a suction force which is created by drawing a vacuum through the surface of the feeder and/or the scrubber. This use of a vacuum can be very effective, but it is costly, noisy and requires frequent maintenance. A second method of controlling the normal force has been used in a machine which employed a precision solenoid and a sophisticated servo-controlled system to physically vary the pressure between the scrubber belt and feed tire. This method has worked satisfactorily but has been costly and difficult to implement.

SUMMARY OF THE INVENTION

A document feeder, according to the present invention, is provided to deliver intermixed documents of various-lengths into a transporter track at a constant speed and with a uniform gap between documents. The feeder employs a first pair of rollers paired together to accept documents fed from a stack by a nudger belt and transport them one at a time. The first pair of rollers embody a scrubber and a feeder which drive in opposite directions to provide separation between documents which may overlap as they come from the nudger belt. The scrubber is driven at a constant speed by an independent motor. Following the first pair of rollers is a set of rollers (herein called the first set) comprising those additional pair or pairs of rollers which are aligned to receive and transport the documents. The first set of rollers and the feeder roller of the first pair are driven at a variable speed by a speed-controlled servo-motor. A second set of rollers following the first set is driven at a higher speed, and at a constant speed ratio to that of the first set of rollers, through a mechanical drive train by the same speed-controlled servo-motor. A third set of rollers is driven at a constant transport speed by a separate motor.

As indicated briefly, the first pair of rollers for separating the bunched together documents into, an end-to-end flow of documents include a feeder and a scrubber. These two rollers are rotated about their axes so that their peripheral surfaces move in opposite directions to provide forces on documents between the surfaces which are tangential to the rollers, and parallel to faces of the documents, causing one document to be advanced in the track and others to be retarded. A force is applied by action of a spring to the axes of the rollers to aid in the production of the desired forces causing the documents to separate.

The first set of rollers include a pair (or pairs) of rollers for accepting a plurality of documents in an end-to-end stream. The second set of rollers include a pair (or pairs) of rollers for accepting a first document and increasing its speed to that of the second plurality of rollers and thereby establishing a gap and progressively increasing the length of the gap between the first and a second document during the time the two documents are controlled by rollers operating at different speeds. The second set of rollers then accept the second document, increasing its speed to equal that of the first document at which time the length of the gap becomes fixed. The speed of the second set of rollers is then changed to match the constant transport speed of the third set of rollers. The third set of rollers then accepts the first document and transports it at the constant transport speed into the transport track.

The speed of the second set of rollers is then changed if it is desired to adjust the gap between the first and second documents. Once the gap between the first and second documents has been changed to a pre-calculated length which approaches the desired standard gap the second set of rollers revert under control of a processor to the constant transport speed to enable a smooth transfer of the second document to the third set of rollers. This final speed change achieves the desired standard gap. The attained standard gap between the first and second documents is maintained by the downstream track. The gap between the second and third documents and between each successive pair of documents is adjusted in the same way.

DESCRIPTION OF A PREFERRED EMBODIMENT

Figure 1:
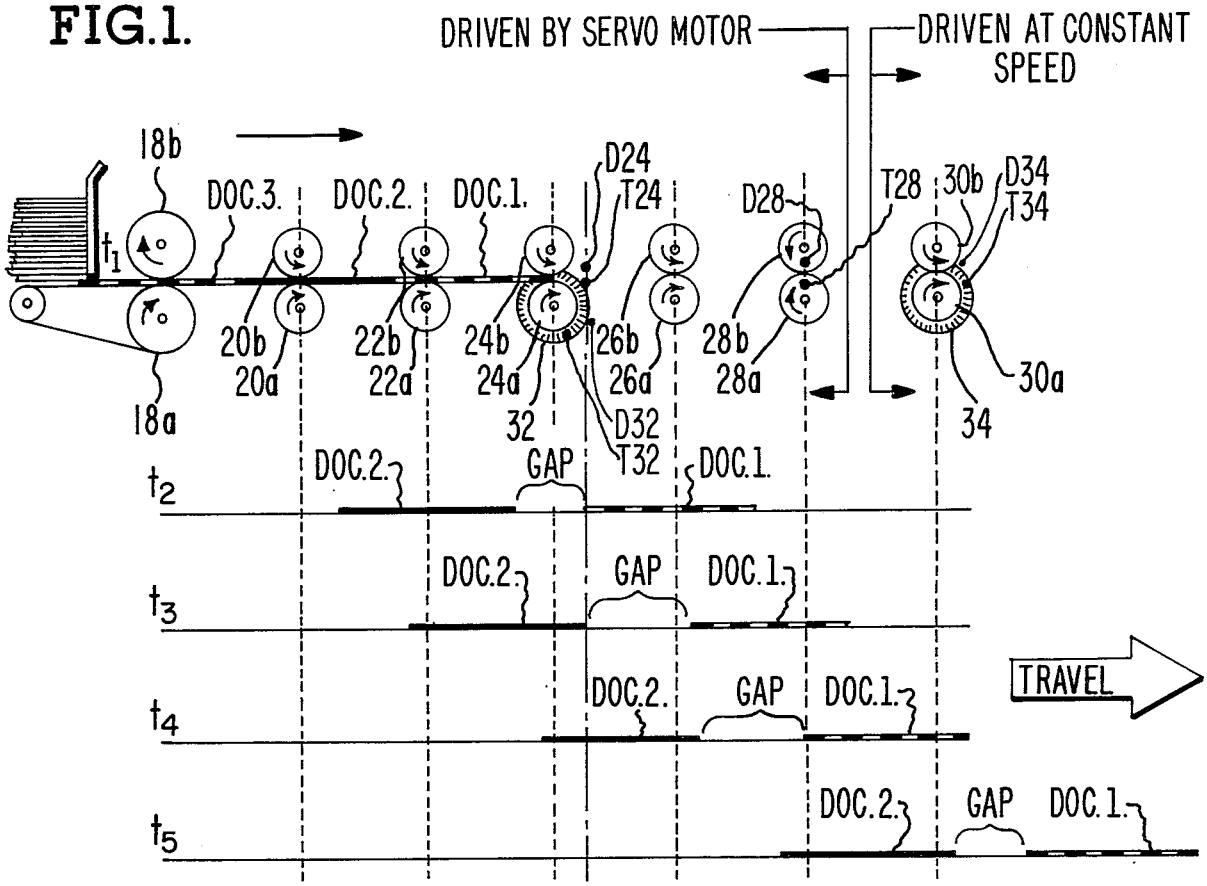
FIG. 1 is a diagram showing an arrangement of rollers according to the invention, together with a timing diagram to illustrate the manner in which gaps are adjusted.

Turn now to FIG. 1 for a description of a basic configuration of the invention. In this view rollers are shown in pairs numbered 18*a*, 18*b*, 20*a*, 20*b*, 22*a*, 22*b* . . . 30*a*, 30*b* where "a" designates a drive roller in each case and "b" an idle roller in all except the case of 18*b*, which is driven at a low speed by a separate motor.

Rollers 18*a*, 20*a*, 22*a*, 24*a*, 26*a*, and 28*a*, are driven by a speed-controlled servo motor. Roller 18*b* is driven by a separate motor. The three rollers 24*a*, 26*a*, and 28*a* are driven at a higher speed than the rollers 18*a*, 20*a*, and 22*a*. The speed ratio between the two sets of rollers is fixed by a mechanical drive train which typically comprises a servo motor M2 driving a timing belt over pulleys having more or fewer teeth according to the speed of rotation desired. A slotted servo timing disc 32 on the shaft of roller 24*a* with a light source D32 and a light sensor T32, which may be configured in the manner of the apparatus shown in U.S. Pat. No. 3,935,447, is available to measure the angular displacement of the servo driven rollers. Transport rollers 30*a* and 30*b* are driven by a separate motor at a constant transport speed. A second slotted timing disc, or track timing dis, 34 is available on the shaft of roller 30*a* with an associated light emitter at D34 and light detector T34 to measure the angular displacement of the transport rollers. Sensors comprising light emitting diodes at D24 and D28 coupled with phototransistors at T24 and T28 are located in the positions indicated to detect the presence of documents in the transport track. The light detectors T24, T28, T32 and T34 provide outputs to a microprocessor which is not shown.

Rollers 24*a* in 24*b* are subjected to high operating pressure and are equipped with surfaces having a high coefficient of friction in order to assure that these rollers will be dominant over rollers 22*a* and 22*b*. The purpose of this dominance is to enable the rollers 24*a* and 24*b* to impose their higher speed on documents before the documents reach the light detector T24.

In FIG. 1, a first document DOC1 and a second document DOC2 are shown in a series of positions which they assume between the rollers during time periods t1, t2 . . . t5.

Rollers 18*a* and 18*b* which both rotate clockwise in the view shown in FIG. 1, serve as separators to separate bunched documents. The documents are fed from the separators at a low servo speed and, ideally, are aligned end-to-end by rollers 18*a* and 18*b* at that time. Overlaps between documents or spaces do occur at this point, however, affecting the final unadjusted gap and making the need for a gap control system all the greater. This alignment of documents is maintained until the first document reaches rollers 24*a* and 24*b*. In the view shown in FIG. 1, this alignment is shown where the first document is indicated by heavy dashed lines labeled DOC1 and the second document is indicated by a heavy solid line labeled DOC2. A third document DOC3 is shown still under control of the rollers 18*a* and 18*b*.

As soon as the first document DOC1 reaches dominant rollers 24*a* and 24*b* it is rapidly accelerated to a higher speed so that a gap starts to open between the first and second documents. As the trailing edge of the first document crosses the gap sensor T24 at time t2, the logic of a central microprocessor (not shown) starts to count the slots as they go by on the servo timing disc 32.

When the leading edge of the second document reaches rollers 24*a* and 24*b* it is rapidly accelerated to the high servo speed. The dominance of rollers 24*a* and 24*b* is such that they will assure that the second document will be up to speed at or before the time t3, when the leading edge reaches the gap sensor T24. At this point in time, the gap stops growing and is maintained because the two documents are traveling at identical speeds. At this time, also, the logic stops counting the slots going by on the servo timing disc. The total of slots counted between the time the trailing edge of the first document passed the sensor T24 and the time the leading edge of the second document arrives at the sensor T24 is directly proportional to the length of the stabilized gap formed at this point.

The speed of the high speed servo rollers 24*a*, 26*a* & 28*a* is matched with the transport speed of rollers 30*a* and 30*b* before the lead edge of the first document reaches rollers 30*a* & 30*b*. As the trailing edge of the first document DOC1 leaves the control of the servo-driven portion of the track by leaving rollers 28*a* and 28*b*, this trailing edge is observed to pass by the sensor T28 as indicated on the line labelled time t4. At this point in time, the servo motor driving the first two sets of rollers can accelerate or decelerate on command from the microprocessor so that the second document DOC2 will catch up with or fall behind the first document. In this way the gap can be adjusted.

In the chosen example, the gap measured was longer than desired so the second document was speeded up to shorten the gap between t4 and t5. A velocity profile was selected or calculated to provide the proper amount of catch-up time and also to return the second document to transport speed before it reached rollers 30*a* and 30*b*. Returning to the transport speed is necessary to prevent a buckling or "tub-of-war" condition between drive rollers which would cause damage to the documents or produce further undesired modifications of the gap.

Figure 2:
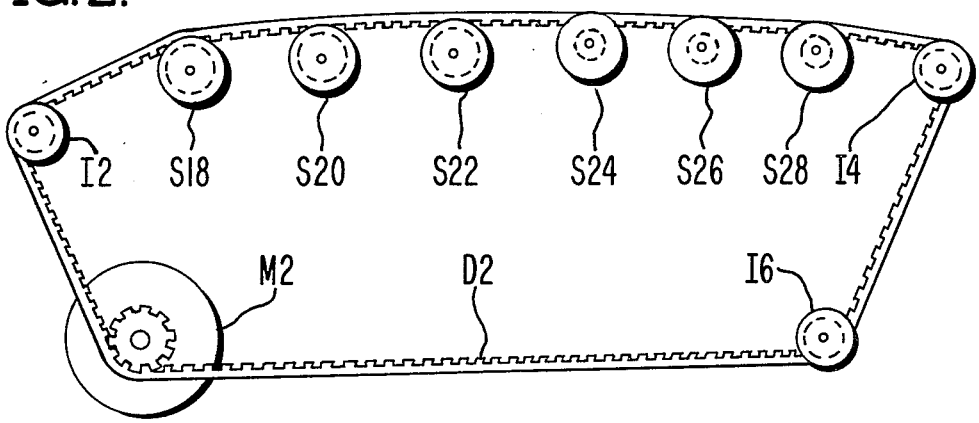
FIG. 2 is a diagram showing mechanical relationships between the servo motor and the drive shafts of the rollers, or tires.

FIG. 2 depicts relationships between pulleys on the drive shafts S18, S20, S22, S24, S26 and S28, the servo motor M2, idle wheels I2, I4 and I6, and a timing belt or driving belt D2. The larger pulleys on S18, S20 and S22 include a larger number of teeth than do the other pulleys and drive their corresponding tires at lower speeds. In this way a constant speed ratio between groups of tires is preserved as the motor speed is changed.

Figure 3:
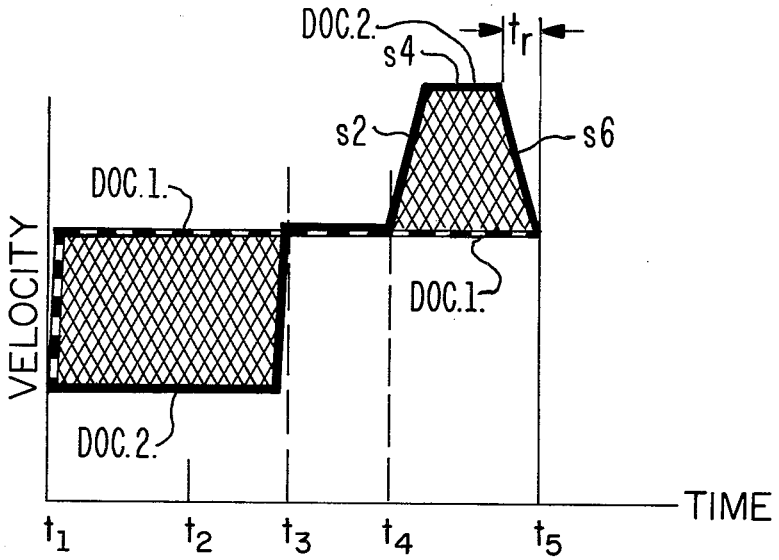
FIG. 3 is a diagram illustrating velocity profiles of two documents which are moved in accordance with the invention.

FIG. 3 shows velocity profiles for the first two documents. The first cross-hatched area between DOC1 and DOC2 is proportional to the naturally formed gap which is measured at time t3, where the increments of time are the same as in FIG. 1. The second cross-hatched area between DOC1 and DOC2 is proportional to the adjustment in the gap which is accomplished by speeding up the motion of the second document, after the first document has moved to the part of the track providing a constant transport speed. Since the absolute speed of rollers 20*a*, 22*a*, 24*a*, 26*a*, and 28*a* are varied without varying the speed ratio, the gaps forming upstream are unaffected by the servo cycle.

A microprocessor is employed to secure the profile indicated between t4 and t5 in FIG. 3 and thereby to correct the gap between documents.

If we assume an initial end-to-end condition between documents DOC1 and DOC2, the gap which will form between the first and second sets of rollers, which may be designated as a naturally formed gap, will be a function of document length and the speed ratio between the slow and high speed servo areas in accordance with the following expression:

$$\text{GAP} = \text{Length}\left(\frac{\text{high speed}}{\text{low speed}} - 1\right).$$

Since the speed of the first and second sets of rollers are varied without varying the ratio, the gaps formed by this portion of the system are unaffected by the servo cycle.

This gap control system will generate a gap between documents which is perfect according to theory and is limited in accuracy only by the hardware and the accuracy of the motor control system. During the time of gap adjustment, t4–t5 on FIG. 1, the movement of the first document is measured by the track timing disc 34, and the movement of the second document is measured by the servo timing disc 32. A real-time reading of gap growth or reduction is directly obtainable by differentially counting the number of slots passing on these two discs. For example, let's assume that each slot on each of the timing discs relates to 0.05 inch of document travel. If 160 slots are counted on the servo timing disc 32 while 120 slots are counted on the track timing disc 34, the gap will have shrunk by two inches that is determined arithmetically by multiplying 0.05 times (160−120). This capability makes extreme accuracy possible, or makes it possible to achieve substantial accuracy with a less accurate motor control system. In the illustrated preferred embodiment a gap adjusting velocity profile is chosen, portions of which are followed in a crude "open-loop" fashion. The real-time reading of gap change is used to decide when to return to transport velocity. The only inaccuracy is contributed when the motor doesn't closely follow the assumed profile during the final return to transport speed which occurs during time interval $t_r$ in FIG. 3.

Other features of this system are available which are useful in certain applications. In the first of these, the servo timing disc can be used to measure the length of the first document before the gap is adjusted. This makes it possible to adjust to an appropriate gap in systems where the desired gap is dependent upon first document length. Such a circumstance might arise during the use of machines having microfilming capability. On these machines, longer documents require more time and therefore longer gaps to reposition the moving lens before the next document arrives.

A second feature which is useful involves a correction of unplanned for variations in the transport speed from one machine section to the next which could result in substantial changes in gap length. The constant gapping feeder described in this application can be changed in such a way that it will yield the desired gap at a critical area far downstream. This is accomplished by moving the track timing disc 34 to the area where it is desired to hold a gap and by making sure the second roller dominates at all interfaces where speed variations might occur. If we then use the differential slot count as a measurement of gap growth or gap reduction we will actually be adjusting the gap to the desired size at the downstream location of the track timing disc. Under these circumstances the actual gap leaving the feeder may be substantially different.

Figure 4:
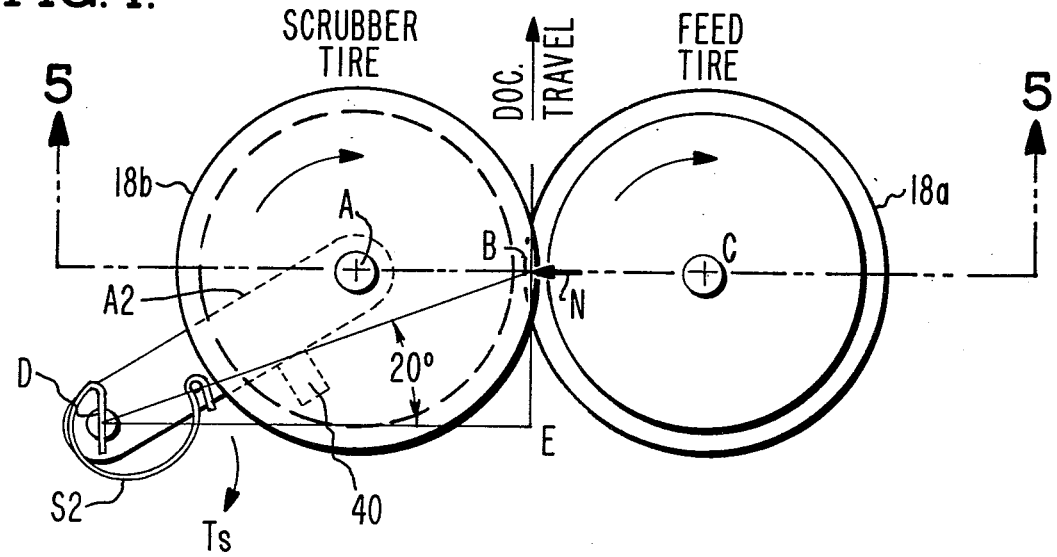
FIG. 4 is a plan view showing relationships between a scrubber and a feeder tire employed to separate documents. It shows that spring which provides the desired pressure when documents are present.
Figure 5:
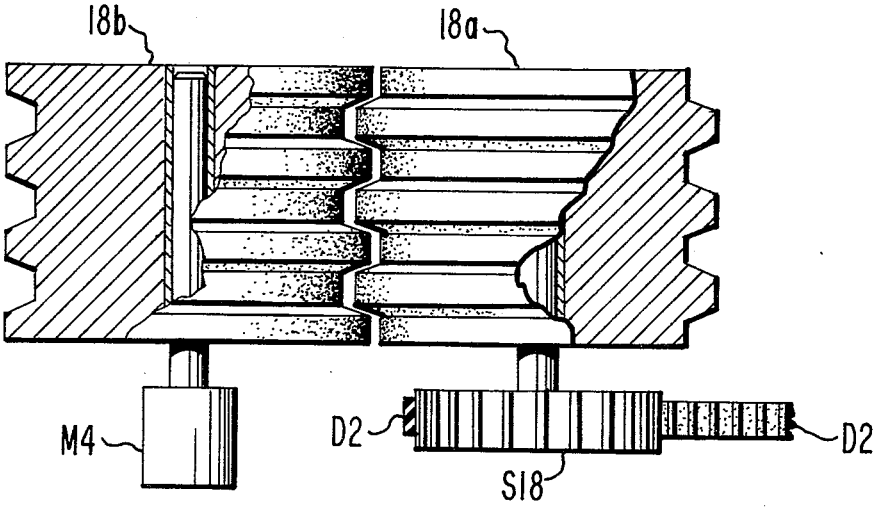
FIG. 5 is a view in partial section along line 5—5 of FIG. 4 showing the staggered arrangement of ribbing between the tires which enables them to turn freely when documents are not present.

Another novel feature of the present invention is the controlled normal force feature which will be best understood from a consideration of FIGS. 4 and 5. As shown in FIG. 4, round tires are used for the feeding and scrubbing elements 18*a* and 18*b*. The feed tire 18*a* is driven by the sevo motor through belt D2 and pulley S18 at a low velocity, the scrubber tire 18*b* is driven at an even lower speed by a separate motor, M4. The scrubber tire 18*b* is supported for rotation at point A on the scrubber link or arm A2. The arm A2 is supported for rotation about an axis at D and is spring-loaded by the spring S2 into the feed tire at an acute angle DBA=angle BDE. In a preferred example, the angle DBA would be twenty degrees. $T_s$ represents the torque exerted on the scrubber link A2 by the spring S2. Up is the coefficient of friction between paper documents which from experience is known to be about 0.2. $U_s$ is the coefficient of friction between the scrubber tire and documents which we will assume to be 0.8, which again is consistent with experience.

When one document is present between the rollers 18*a* and 18*b*, it travels with the feed tire 18*a* while the counter rotating scrubber 18*b* slips against it. The reaction force due to the firction between the scrubber and the document acts tangentially at point B and tends to disengage the scrubber from the feed tire. When two documents are present the second document moves with the scrubber while the first document, as before, moves with the feed tire. A reaction force is generated as when only one document is present, but in this case it is proportional to the lower coefficient of friction between the two paper documents at point B.

Torque $T_s$ is balanced by the normal force N and a tangential frictional force at point B. The static balancing equation is:

$T_s = uN\overline{DE} + N\overline{BE}$ where u=the applicable coefficient of friction Substituting values and solving for N:

$$T_s = uN\overline{BD}\cos 20° + N\overline{BD}\sin 20°$$

$$N = \frac{T_s}{\overline{BD}}\left(\frac{1}{.94u + .34}\right) = k\frac{1}{.94u + .34}$$

where $k = (T_s)/(BD)$

With one document at B; $u = Us = 0.8$ and $N = N_1 = 0.916k$

With two documents at B; $u = Up = 0.2$ and $N = N_2 = 1.89k$

When a gap occurs and no documents are present at B, the scrubber link AD positions itself against a fixed stop at 40. While the scrubber and feed tires do overlap, physical contact is avoided when no documents are present because of the staggered rib pattern of the tires. An exemplary rib pattern is shown in the sectional view of FIG. 5, where FIG. 5 is a partial section taken along the lines 5—5 of FIG. 4. All the reaction force when no documents are present is exerted against the fixed stop so the normal force is equal to zero.

The staggered ribbing shown in FIG. 5 and the spring loading configuration indicated at FIG. 4 establish the desired relationships between the normal forces and the scribber-feeder. When no documents are present and any friction would be wasteful, the normal force is zero. When two or more documents are present, and extra pressure is required to assure separation, the normal force is maximized. When only one document is present and a minimal force is required to drive the document forward, the normal force is less than half the maximum possible value.

What is claimed is:

1. In a document feeder for delivering intermixed documents of varied lengths at a constant transport speed and with the same gap between documents, an arrangement comprising:

a first plurality of rollers driven at a variable speed by a speed-controlled servo-motor;

a second plurality of rollers driven at a higher variable speed than the first plurality of rollers through a mechanical drive train by said speed-controlled servo-motor;

said mechanical drive train maintaining a fixed speed ratio between the first plurality of rollers and the second plurality of rollers;

said first plurality of rollers including rollers for accepting first and second documents and transporting them in succession to successive pairs of said rollers;

said second plurality of rollers including rollers for accepting the first document from said first plurality of rollers and imparting increased speed to the first document to develop an increasing gap between the first and second documents;

said second plurality of rollers accepting the second document and imparting said increased speed to the second document to maintain the length of said gap;

means for sensing the passage of said first and second documents and providing signals for use in controlling the speed of said servo-motor and changing the speed of said second plurality of rollers to match the constant transport speed of the document feeder and transmitting the first document to a successive stage of said document feeder operating at the constant transport speed;

means for sensing the passage of said first and second documents and providing signals of use in controlling the speed of said servo-motor and changing the speed of said second plurality of rollers to alter the speed of said second document and thereby produce changes in the length of said gap until a desired gap is approached, then reverting to said constant transport speed during which time the desired final gap is attained; and said successive stage of said feeder accepting the second document and transporting it at said constant speed while maintaining said desired gap.

2. The invention as claimed in claim 1, in which:

the successive stage of said feeder includes a third plurality of rollers driven at said constant transport speed;

said third plurality of rollers transporting said first and second documents at said contant transport speed while maintaining said desired gap.

3. In a document feeder for delivering intermixed documents of varied lengths at the same speed and with the same gap between documents, an arrangement comprising:

a first plurality of rollers driven at a variable speed by a speed-controlled servo-motor;

a second plurality of rollers driven at a higher variable speed than the first plurality of rollers through a mechanical drive train by said speed-controlled servo-motor;

said mechanical drive train maintaining a fixed speed ratio between the first plurality of rollers and the second plurality of rollers;

a third plurality of rollers driven at a constant transport speed;

said first plurality of rollers including rollers for accepting first and second documents and transporting them in succession to successive pairs of said rollers;

said second plurality of rollers including rollers for accepting the first document from said first plurality of rollers and imparting increased speed to the first document to develop an increasing gap between the first and second documents;

said second plurality of rollers accepting the second document and imparting said increased speed to the second document to maintain the length of said gap;

means for sensing the passage of said first and second documents and providing signals for use in controlling the speed of said servo-motor and changing the speed of said second plurality of rollers to match the constant transport speed of the third plurality of rollers;

said third plurality of rollers accepting the first document and transporting it at said constant transport speed;

said means for sensing the passage of said documents providing further signals of use in controlling the speed of said speed-controlled servo-motor and changing the speed of said second plurality of rollers to alter the speed of said second document and introduce adjustments to said gap, then reverting to said transport speed; and said third plurality of rollers accepting the second document and transporting it at said constant transport speed while maintaining said adjusted gap.

4. The invention as claimed in claim 1, 2 or 3 in which:

the first plurality of rollers includes a pair of rollers functioning as a feeder roller and a scrubber roller, in which the feeder roller rotates in a direction to drive a selected document in a forward direction between the rollers and the scrubber roller drives in the opposite direction to separate additional documents from the selected document;

the feeder roller including a first tire serving as a feeding element and the scrubber roller including a second tire serving as a scrubbing element;

each tire including a pattern of ribs along the periphery of its face; and said patterns of ribs being staggered relative to each other so that the tire patterns overlap when the rollers are operable, but do not physically engage each other.

5. The invention as claimed in claim 1, 2 or 3 in which:

the first plurality of rollers includes a pair of rollers functioning as a feeder roller and a scrubber roller, in which the feeder roller rotates in a direction to drive a selected document in a forward direction between the rollers and the scrubber roller drives in the opposite direction to separate additional documents from the selected document;

the feeder roller includes a first tire serving as a feeding element and the scrubber roller includes a second tire serving as a scrubbing element;

each tire including a pattern of ribs along the periphery of its face;

said patterns of ribs being staggered relative to each other so that the tire patterns overlap when the rollers are operable, but do not physically engage each other; and mechanical means biasing the scrubber roller to provide a substantially greater normal force when more than a single document is positioned between the tires;

whereby a controlled force normal to documents in the transport path is made available to separate overlapping documents in the transport column and transport them substantially end-to-end to successive rollers.

6. In a document feeder for delivering intermixed documents of different lengths at a preselected speed and with preselected gaps between documents, an arrangement comprising:

first means for receiving and transporting a first and a second document at variable speeds;

second means coupled to receive said succession of documents and transport them at a higher range of variable speeds;

means coupled between the first and second means to provide a fixed ratio of speed between the first and second means and thus to develop a gap between said first and second documents controlled respectively by said first and second means;

third means operable at a fixed speed to receive each of the documents of said succession of documents and transport it at a preselected speed; and means, responsive to the passage of the documents, to provide signals of use in varying in speed of said first and second means in a manner to enable adjustment of the gap between a first document having a fixed speed under control of the third means and a second document under control of the second means and adjustment of the speed of travel of said second document to a fixed value as said second document is delivered to control by said third means.

7. In a document feeder for delivering intermixed documents of varied lengths at the same speed and with the same gap between documents, an arrangement comprising:

a pair of rollers functioning as a feeder roller and a scrubber roller;

the feeder roller being supported by mechanical means and mechanically rotated in a direction to drive a selected document in the forward direction of a transport train;

the scrubber roller being supported by mechanical means providing rotation in a counter-direction and applying forces to enable separation of additional documents from the selected document;

the feeder roller including a first tire serving as a feeding element and the scrubber roller including a second tire serving as a scrubbing element;

each tire including a pattern of ribs along the periphery of its face;

said patterns of ribs being staggered relative to each other so that the tire patterns may overlap when the rollers are operable without physically engaging each other;

said ribs being formed to include outer faces having essentially cylindrical outer peripheries and to be separated from each other at their bases by cylindrical inner peripheries, said peripheries being oriented to be essentially parallel to axes through the centers of the respective tires;

said ribs including walls extending from the inner peripheries to the outer peripheries, whereby the ribs resemble gear teeth which may intermesh without touching;

a spring bias for the scrubber roller;

said spring bias being applied by a spring positioned in a manner such that a substantially greater normal force is applied when more than a single document is positioned between the tires;

whereby a controlled force normal to documents in the transport path is made available for use in separating overlapping documents in the transport path;

driver means coupled by a drive train to a first plurality of rollers, including the feeder roller, to drive them at a variable speed;

said drive train driving a second plurality of rollers at a higher variable speed than the first plurality of rollers;

said drive train maintaining a constant speed ratio between the first plurality of rollers and the second plurality of rollers;

said first plurality of rollers accepting first and second documents and transporting them in succession to successive pairs of said rollers;

said second plurality of rollers including rollers for accepting the first document from said first plurality of rollers and imparting increased speed to the first document to develop an increasing gap between the first and second documents;

said second plurality of rollers accepting the second document and imparting said increased speed to the second document to maintain the length of said gap at a fixed value;

a third plurality of rollers driven at a constant transport speed;

said third plurality of rollers accepting the first document and transporting it at said constant transport speed;

said drive train changing the speed of said second plurality of rollers to alter the speed of said second document and introduce adjustments to said gap until a desired adjusted gap is produced, then reverting to said transport speed; and said third plurality of rollers accepting the second document and transporting it at said constant transport speed while maintaining said adjusted gap.

* * * * *